US008617662B2

(12) United States Patent
Yu

(10) Patent No.: US 8,617,662 B2
(45) Date of Patent: Dec. 31, 2013

(54) TEXTILE BLIND SLAT

(75) Inventor: Jianming Yu, Wenzhou (CN)

(73) Assignee: Lande Braid Industry (Wenzhou) Co., Ltd., Ruian, Zhejiang Province (CN)

( * ) Notice: Subject to any disclaimer, the term of this patent is extended or adjusted under 35 U.S.C. 154(b) by 0 days.

(21) Appl. No.: 13/606,009

(22) Filed: Sep. 7, 2012

(65) Prior Publication Data

US 2012/0325415 A1 Dec. 27, 2012

Related U.S. Application Data

(63) Continuation-in-part of application No. 12/133,368, filed on Jun. 5, 2008, now abandoned.

(51) Int. Cl.
*B05D 3/12* (2006.01)

(52) U.S. Cl.
USPC ..... 427/369; 28/169; 160/236; 160/178.1 R; 427/370; 427/385.5; 427/393.3

(58) Field of Classification Search
USPC ..... 160/168.1 R, 173 R, 178.1 R, 236; 427/369, 430.1, 434.2, 434.4, 434.6, 427/439, 370, 385.5, 393.3; 28/169
See application file for complete search history.

(56) References Cited

U.S. PATENT DOCUMENTS

| | | | | | |
|---|---|---|---|---|---|
| 4,092,286 | A * | 5/1978 | Noll et al. | 524/591 |
| 5,273,781 | A * | 12/1993 | Shu | 427/176 |
| 5,311,814 | A * | 5/1994 | Kierson | 101/6 |
| 5,344,675 | A * | 9/1994 | Snyder | 427/388.4 |
| 5,612,126 | A * | 3/1997 | Cross et al. | 442/227 |
| 6,105,657 | A * | 8/2000 | Zorbas | 160/236 |
| 2006/0144526 | A1* | 7/2006 | McGinley | 160/84.01 |
| 2006/0175587 | A1* | 8/2006 | Kasowski | 252/601 |

* cited by examiner

*Primary Examiner* — Alexander Weddle

(57) ABSTRACT

A method of producing textile blind slat, includes (a) weaving an elongated textile strip, wherein two longitudinal edge portions are double layered, for respectively forming elongated inner space therein; (b) immerging the elongated textile strip into a hardening agent, wherein the elongated textile strip passes through the hardening agent at a predetermined speed; (c) drying the elongated textile strip after the step (b) at a temperature between 100-180 Celsius degree; and (d) flattening the elongated textile strip after the step (c), so as to serve as a blind slat.

20 Claims, 4 Drawing Sheets

TEXTILE BLIND SLAT

CROSS REFERENCE OF RELATED APPLICATION

This is a Continuation-In-Parts application of an application having an application Ser. No. 12/133,368 filed on Jun. 5, 2008.

BACKGROUND OF THE PRESENT INVENTION

1. Field of Invention

The present invention relates to a Venetian blind, and more particularly to a blind slat made of textile, wherein the textile is processed to be hardened, so as to be capable of serving as a blind slat of the Venetian blind.

2. Description of Related Arts

At present, there are many kinds of Venetian blind slat. They are usually made of hard materials, such as aluminum alloy, wood, bamboo and so on. Aluminum alloy is light in weight and waterproof, but the equipment for producing the aluminum alloy slat is quite expensive. In addition, the non-ferrous metal is becoming less and less, so that the cost of the aluminum alloy slat is going to rise.

Producing the wood and bamboo slat is difficult and has too many procedures. Furthermore, the wood and bamboo slat is poorly waterproof and easily gets transformed. Likewise, the wood and bamboo is less and less and using wood material in a large amount does no good to the environment, so that a cheap and good substitute has to be developed.

The Venetian blind slat made of plastic or resin is gradually developed. However, when this kind of Venetian blind slat is exposed to sunlight, it gets aged quickly, which will affects its quality and outer appearance. Furthermore, the used Venetian blind after service is not environmentally friendly, so as to be gradually driven out of market.

The above mentioned hard materials have an important but unnoticed drawback. Because the blind slat is hard material, the width of the blind slat is predetermined during the production. When the window of the customer is not of standard size, these predetermined blind slats can not be used. The cost of customer made Venetian blind is very high, and meanwhile, the transportation cost of the blind slats is high too.

The blind slat made of hard material has another drawback of having a pair of slits at both edge portions of the blind slat for a rope passing through to connect all the blind slats. These slits will allow the sunlight passing therethrough, which will affect the shading effect of the Venetian blind.

However, soft materials such as textile are not suitable for making blind slat, because the blind slat must have a certain degree of hardness. Moreover, the textile has no advantages of being waterproof, flame retardant, or anti-ultraviolet.

SUMMARY OF THE PRESENT INVENTION

An object of the present invention is to reinforce the hardness of the textile, so as to make the textile suitable for applying to the Venetian blind slat.

Another object of the present invention is to provide a textile blind slat, which has advantages of being water proof, flame retardant, and anti-ultraviolet, which conforms the international standards.

Another object of the present invention is to provide a textile blind slat, whose width can be determined by the customer.

Another object of the present invention is to provide a textile blind slat, which is suitable for transportation, manufacture and use.

Another object of the present invention is to provide a method of producing a textile blind slat, which hardens the textile to be suitable for serving as a blind slat.

Another object of the present invention is to provide a method of producing a textile blind slat, wherein the bind slat has advantages of being water proof, flame retardant, and anti-ultraviolet.

Another object of the present invention is to provide a method of producing Venetian blind, which includes no opening a pair of slits on both edge portions of the blind slat.

Accordingly, in order to accomplish the above objects, the present invention provides a textile blind slat including:

an elongated textile strip, wherein two longitudinal edge portions are double layered for respectively forming elongated inner chambers therein;

a hardening agent penetrated into the elongated textile strip, so as to harden the elongated textile strip; and two poles having a certain elasticity, inserted into the elongated inner chambers of the two longitudinal edge portions respectively to further harden the elongated textile strip.

The present invention also provides a method of producing textile blind slat, including following steps of:

(a) weaving an elongated textile strip, wherein two longitudinal edge portions thereof are double layered for respectively forming elongated inner space therein;

(b) immerging the elongated textile strip into hardening agent, wherein the elongated textile strip passes through the hardening agent at a predetermined speed;

(c) squeezing and pressing the elongated textile strip to squeeze out an excessive amount of the hardening agent and evenly distributing the hardening agent on the elongated textile strip;

(d) drying the elongated textile strip after being immerged in the hardening agent at high temperature; and (e) flattening the elongated textile strip after being dried at the high temperature, so as to serve as a blind slat.

These and other objectives, features, and advantages of the present invention will become apparent from the following detailed description, the accompanying drawings, and the appended claims.

DETAILED DESCRIPTION OF THE PREFERRED EMBODIMENT

Figure 1:
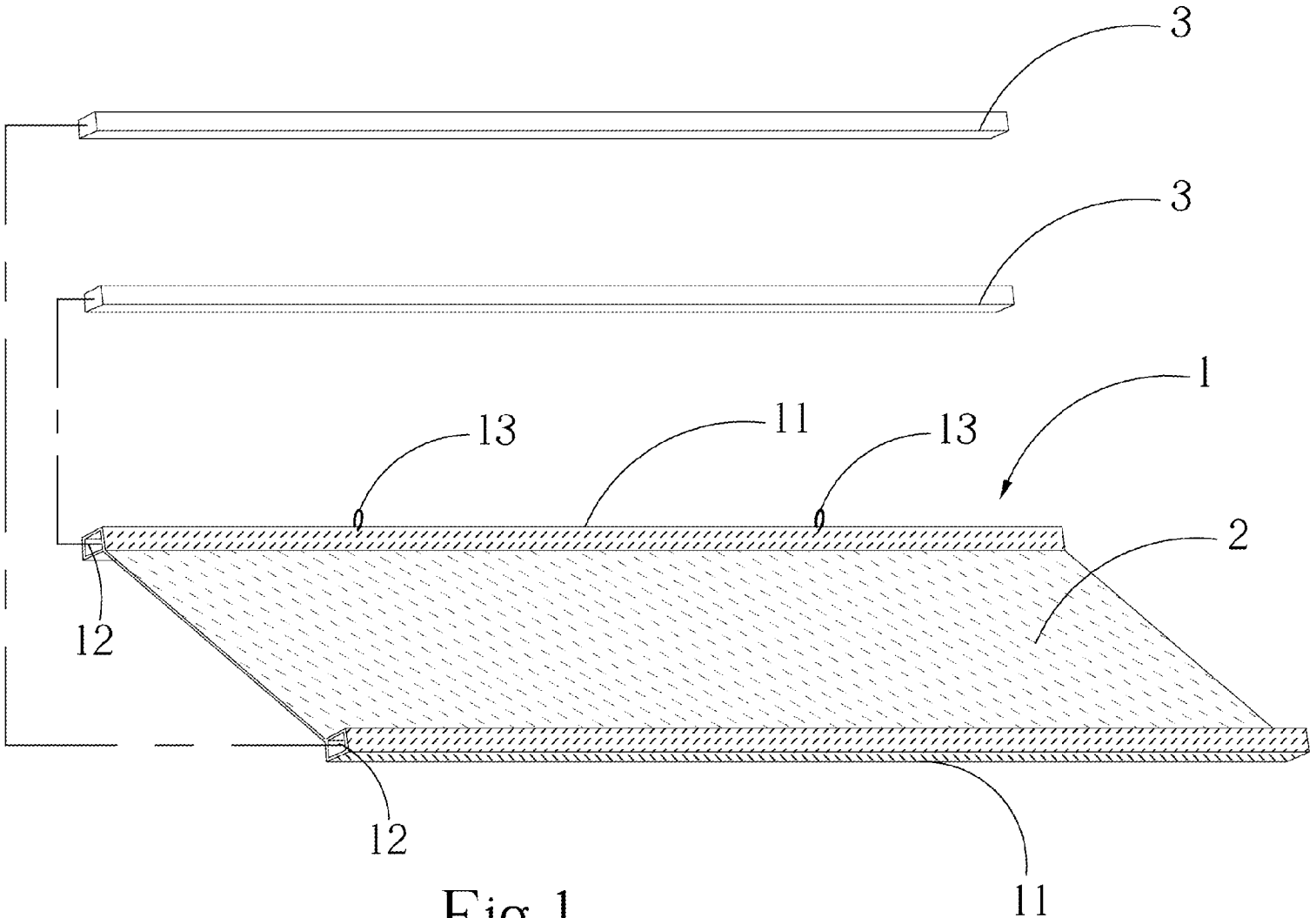
FIG. 1 is a perspective view of a blind slat according to a preferred embodiment of the present invention, illustrating a practical application of the blind slat.

Referring to FIG. 1 of the drawings, according to a preferred embodiment of the present invention, a textile blind slat includes an elongated textile strip 1, a hardening agent 2 for penetrating into the elongated textile strip 1 and two poles 3.

Two longitudinal edges 11 of the elongated textile strip 1 are woven to be double layered, so as to respectively form elongated inner chambers 12 therein. The textile is polyester, including polyester filament yarn, polyester drawn textured yarn, polyester high elastic filament, polyester network filament, and so on. The polyester has high intensity, resistance to aging, water and high temperature up to 180 Celsius degree. In addition, the polyester is mildewproof. Therefore, the polyester is an ideal material to produce Venetian blind slat.

A transverse length of the blind slat is 2-15 cm, a knitting density is 3-40 lines per centimeter, and a thickness of the knitting is 0.1-2 mm. The longitudinal edges 11 are woven to be double layered for respectively forming elongated inner chambers 12.

The hardening agent includes rigid polyacrylate latex, thermoplastic polyurethane emulsion, and flame retardant agent, wherein a solid content of thermosetting polyacrylate latex added therein is 3-4 times larger than a solid content of the thermoplastic polyurethane emulsion.

The solid content of the thermoplastic polyurethane emulsion is 20-30% and a glass transition temperature thereof is 35-40 Celsius degree.

20% phosphorus flame retardant, 60% thermosetting polyacrylate latex and 20% water are added according to mass fraction and form a mixed solution; the mixed solution is further added with the rigid polyacrylate latex, so as to form the hardening agent.

The textile is immerged in the rigid polyacrylate latex, the thermoplastic polyurethane emulsion and the flame retardant, in such a manner that the textile fibers are attached with each other after fully crosslinking and a hardened film is formed on surface of the textile fibers, so that the textile feels hard, thick and plump. The hardening agent contains no free formaldehyde and also releases no formaldehyde. Because of using the thermoplastic polyurethane emulsion, the textile has resistance to abrasion, oil, low temperature and a good resilience, so that the blade slat produced by the method of the present invention is able to recover a flat state when reopened after being rolled up to be stored for a certain period, rather than stays in an arc shape of being rolled up. Principles thereof are as follows. Net-shaped branched chains exist between macromolecule chains of the thermoplastic polyurethane. The net-shaped branched chains transform when the macromolecule deforms under stress and thus store potential energy produced by the transforming; once outer stress disappears, the macromolecule is able to recover from the displacement because of the potential energy of the branched chains.

The two poles 3 are hard and have certain elasticity for being inserted into the elongated inner chambers 12 of the two longitudinal edge portions 11 respectively, so as to further reinforce the hardness of the textile. The pole 3 has a diameter of 1-10 mm. The pole is made of glassfiber, metal, or plastic.

The elongated textile strip 1 further includes at least two rings 13 spacedly provided at a longitudinal side of the elongated textile strip 1, thus the textile blind slats are connected via the rings 13 provided on the elongated textile strip 1, rather than via opening a pair of slits on both edge portions of the blind slat according to prior arts, which affects shading effect of the Venetian blind. The rings 13 are directly woven into or afterward stitched upon the elongated textile strip 1. Each ring 13 has a diameter of 1-30 mm, and a density of the rings 13 is 1-10 per meter.

The textile can be dyed to any color, so that the textile blind slat can be of various colors. Likewise, the textile blind slat can be woven to various patterns thereon, which will not be achieved by traditional blind slat.

Figure 3:
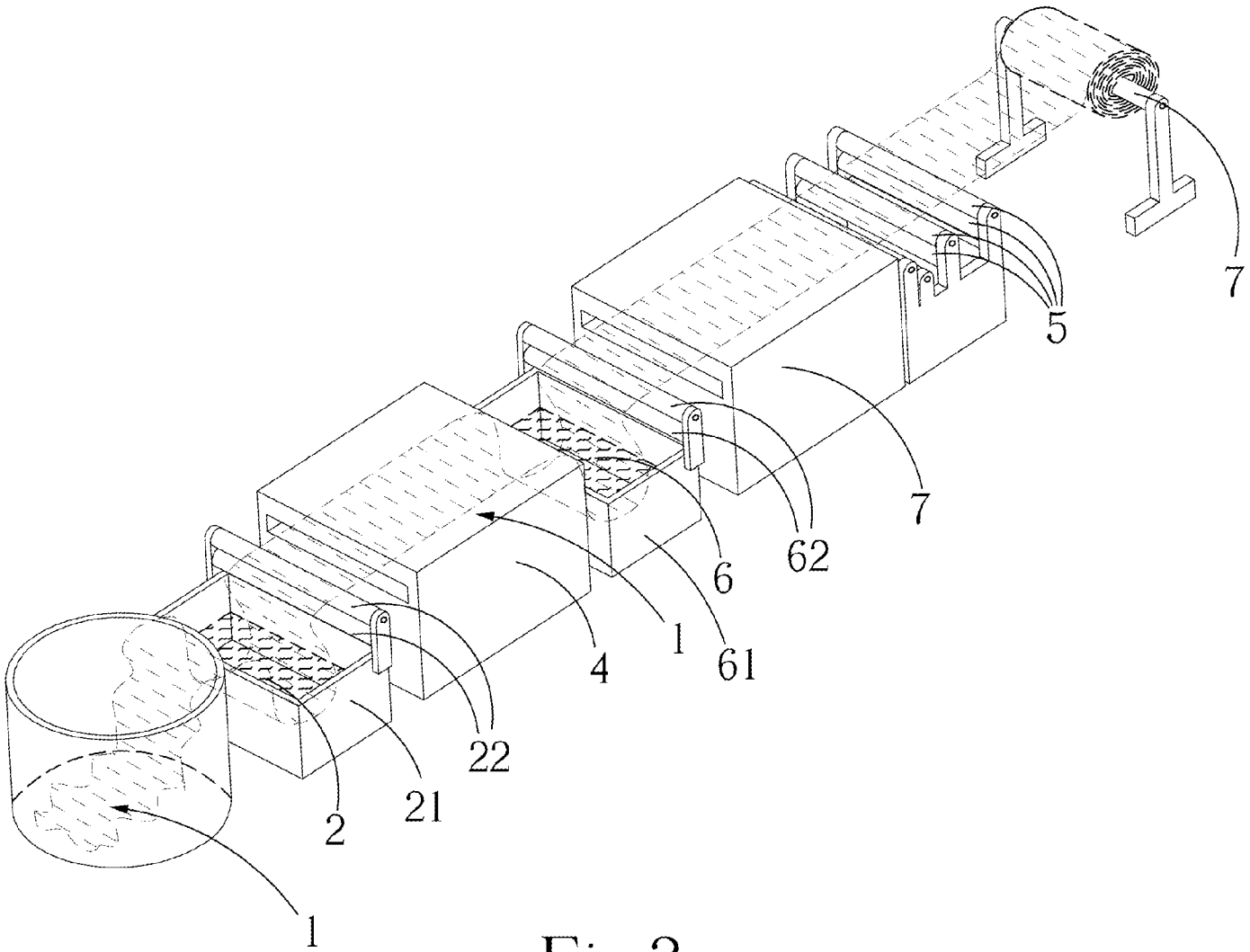
FIG. 3 is a flowchart of a method of producing a blind slat according to the above preferred embodiment of the present invention.

Referring to FIG. 3 of the drawings, the present invention also provides a method of producing textile blind slat, including:

(a) weaving an elongated textile strip 1, wherein two longitudinal edge portions 11 are double layered for respectively forming elongated inner chambers 12 therein;

(b) immerging the elongated textile strip 1 into a hardening agent 2, wherein the elongated textile strip 1 passes through the hardening agent 2 at a predetermined speed;

(c) drying the elongated textile strip 1 after being immerged into the hardening agent 2 at a temperature between 100-180 Celsius degree; and (d) flattening the elongated textile strip 1 after being dried at high temperature, so as to serve as a blind slat.

Figure 2:
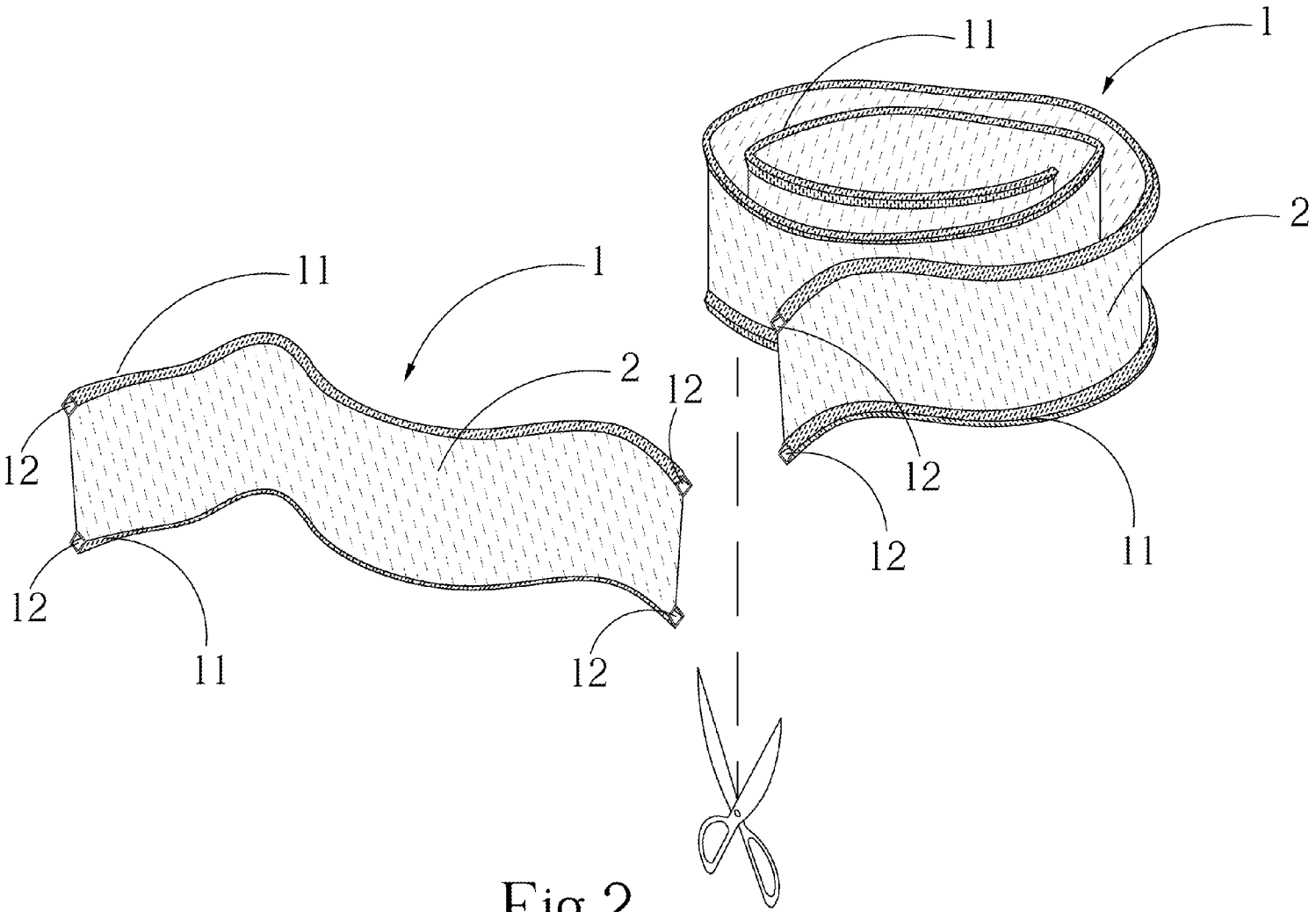
FIG. 2 is a perspective view of the blind slat according to the above preferred embodiment of the present invention.

As shown in FIG. 2, the elongated textile strip 1 can be woven to any length, and rolled to be stored to save space. When producing the Venetian blind, the blind slat can be cut to any length according to practical needs, so as to produce a Venetian blind with an appropriate width.

The textile material of the elongate textile strip 1 is polyester, including polyester filament yarn, polyester drawn textured yarn, polyester high elastic filament, polyester network filament, and so on. The polyester has high intensity and resistance to ageing, water and high temperature up to 180 Celsius degree. In addition, the polyester is mildewproof. Therefore, the polyester is an ideal material to produce Venetian blind slat.

The transverse length of the blind slat is 2-15 cm, a knitting density is 3-40 lines per centimeter, and a thickness of the knitting is 0.1-2 mm, wherein the longitudinal edge 11 is woven to be double layered to form an elongated inner chamber 12; the elongated inner chamber 12 is for containing the pole 3 to further reinforce hardness of the blind slat.

Besides, the textile can be dyed to any color, so that the textile blind slat can be of various colors. Likewise, the textile blind slat can be woven to various patterns thereon, which will not be achieved by traditional blind slat.

The elongated textile strip 1 further includes at least two rings 13 spacedly provided at a longitudinal side of the elongated textile strip 1, thus the textile blind slats are connected via the rings 13 provided on the elongated textile strip 1, rather than via opening a pair of slits on both edge portions of the blind slat according to prior arts, which affects shading effect of the Venetian blind. The rings 13 are directly woven into or afterward stitched upon the elongated textile strip 1. Each ring 13 has a diameter of 1-30 mm, and a density of the rings 13 is 1-10 per meter.

The above steps (a) (b) (c) (d) may be proceeding simultaneously. Or the steps (b) (c) (d) may be proceeding simultaneously, after the step (a) is done. As showed in FIG. 3, according to the preferred embodiment of the present invention, the steps (b) (c) (d) are proceeding at a speed of 2-50 m/s simultaneously.

In the step (b), the hardening agent 2 is the rigid polyacrylate latex. As showed in FIG. 3, the elongated textile strip 1 passes through a hardening agent container 21 containing the rigid polyacrylate latex at a predetermined speed to fully contact the rigid polyacrylate latex, so as to ensure that the rigid polyacrylate latex is fully penetrated into the elongated textile strip 1.

According to the preferred embodiment of the present invention, the elongated textile strip 1 moves at a speed of 6-8 m/min; the elongated textile strip 1 is immerged in the hardening agent container 21 for 7-8 sec.

After the step (b), the method of the present invention further includes step (b1) of squeezing the elongated textile strip 1 for extruding the extra hardening agent and evenly distributing the hardening agent 2 on the elongated textile strip 1. The elongated textile strip 1 is squeezed by a pair of squeezing rollers 22. When the elongated textile strip 1 after being immerged in the hardening agent 2 passes through a space between the pair of squeezing rollers 22, the extra hardening agent 2 is extruded and the hardening agent 2 is evenly distributed on the elongated textile strip 1.

In step (c), the elongated textile strip 1 is dried in a first drying oven 4 having a temperature of 100-180 Celsius degree. As showed in Table 1, at a temperature below 100 Celsius degree, the used hardening agent 2 fails in crosslinking, i.e., the hardening agent 2 fails to form into films after solidifying and also connects with the elongated textile strip 1 without chemical bonds, in such a manner that the hardening agent 2 has no effects of hardening after being fully solidified and even may be detached; however, at a temperature above 180 Celsius degree, according to the prior arts, because of the too high temperature, molecules of the hardening agent 2 are heated to degrade to further embrittle, even carbonize, so that produced blind slats have no elasticity. The textile is immerged in the rigid polyacrylate latex; and then after fully crosslinking, the textile fibers are boned with each other and a hardened film is formed on surface of the textile fibers, so that the textile feels hard, thick and plump. The hardening agent 2 contains no free formaldehyde and also releases no formaldehyde.

TABLE 1

| | temperature (Celsius degree) | | | | |
|---|---|---|---|---|---|
| | 80 | 100 | 160 | 180 | 200 |
| state of blind slat | not hardened | hardened and elastic | hardened and elastic | hardened and elastic | rubber-generated and embrittled |

In the step (d), the elongated textile strip 1 after being dried at the high temperature is flattened by passing through a pair of flattening rollers 5, so as to serve as the blind slat.

Figure 4:
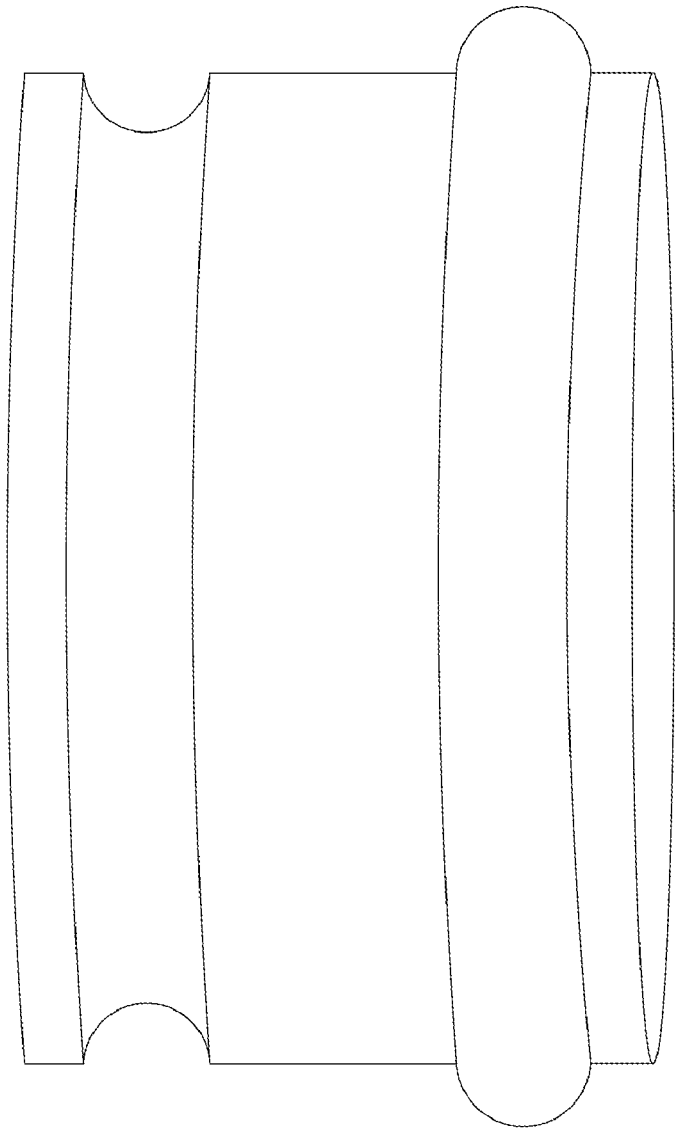
FIG. 4 is a perspective view of a flattening roller used in the method according to the above preferred embodiment of the present invention.

As showed in FIG. 4, each of the flattening rollers 5 in the step (d) has a concave part, a convex part and a flat part simultaneously. The flattening rollers 5 are at a temperature of 160 Celsius degree.

Each flattening roller 5 has a diameter of 400 mm and a width of 200 mm, wherein the concave part and the convex part respectively have a width of 51 mm; the flat part is provided between the concave part and the convex part and has a width of 10 mm. The above size of the flattening rollers 5 depends on a width of the blind slat and can be adjusted according to different widths of the blinds slat. The flattening rollers 5 are designed like this to realize that working position of the flattening rollers 5 can be adjusted anytime during a whole producing and flattening process, wherein the concave part, the convex part and the flat part are available to be used to correct a tightness of the blind slat without any detachment or change of the flattening rollers 5, so as to avoid different tightness of a side, two sides or a middle part of the blind slat caused by different tensile forces of longitudinal lines in different parts of the blind slat during the whole producing and flattening process. Table 2 shows specific adjustments.

TABLE 2

| appearance of blind slat | usage of four flattening rollers |
|---|---|
| no defect | passing through four flat parts |
| width larger than required value | passing through three flat parts and then a concave part; or passing through two flat parts and two concave parts |
| width smaller than required value | passing through three flat parts and a convex part; or passing through two flat parts and two convex parts |
| two loose sides and a tight middle part | passing through a flat part and three concave parts; or passing through two flat parts and two concave parts |
| two tight sides and a loose middle part | passing through a concave part and three convex parts; or passing through two concave parts and two convex parts |
| a loose side and a tight side | passing through two concave parts and two convex parts |

Before the step (d), the method of the present invention further includes following steps of:

(c1) immerging the elongated textile strip 1 into an additive agent 6, wherein the elongated textile strip 1 passes through the additive agent 6 at a predetermined speed;

(c2) squeezing the elongated textile strip 1 for extruding the extra additive agent 6 and evenly distributing the additive agent 6 on the elongated textile strip 1; and (c3) drying the elongated textile strip 1 after being immerged in the additive agent 6 at a temperature between 100-180 Celsius degree.

The additive agent 6 includes Fluorinated Compounds added into water based on a ratio of 15-70 g/L to produce a solution whose pH is 4-5, which forms a layer of substances on surface of the textile to change the surface from a state of high energy into a state of low energy to prevent liquid from passing through the textile, so as to be waterproof. Tensile force of a critical surface of the textile is lowered by changing property of the surface of the textile. Meanwhile, relatively large contact angles are generated for oil having the relatively small surface tensile force, so as to be oil proof. Thus the textile is protected from oily dirt and aqueous dirt. The Fluorinated Compounds contains no perfluorooctanoic acid (PFOA), which is forbidden by European Union.

The additive agent 6 further includes a flame retardant agent, such as bromine, antimony, phosphorus compounds and so on. The flame retardant agent will melt under a high temperature and cover the textile to block the air flow, which will prevent the combustible gas produced in the textile diffusing outwards, or decompose non-combustible gas to dilute the combustible gas, or lower the melting temperature of the textile, so that the textile drops while melting.

The additive agent 6 further includes an ultraviolet absorber agent added with water based on a ratio of 30-50 g/L to form a solution, which can absorb the ultraviolet and transform the ultraviolet into harmless radiation waves, or reflect the ultraviolet outwards, so as to be protective.

Preferably, the ultraviolet absorber agent can be triazine derivatives

The additive agent 6 further includes a sun screen multi-function coating, wherein sun screen agents, such as titanium oxide, black carbon, or paint, are added into a coating agent to form the sun screen multi-function coating; the sun screen agent are added with water based on a ratio of 2:8. Titanium dioxide is preferred.

In the step (c1), the additive agent 6 is in an additive agent container 61, and the elongated textile strip 1 passes through the container 61 at a predetermined speed, so as to ensure that the additive agent 6 is fully penetrated into the elongated textile strip 1. In the step (c2), the elongated textile strip 1 is squeezed by a second pair of squeezing rollers 62. When the elongated textile strip 1 passes through a space between the second pair of squeezing rollers 62, the extra additive agent 6 is extruded. In the step (c3), the elongated textile strip 1 is dried in a second drying oven 7 having a temperature 100-180 Celsius degree.

After the step (d), the method of the present invention further includes a step of: (e) winding the elongated textile strip 1 to form a roll of elongated textile strip 1, so as to be easily stored. As shown in FIG. 3, the elongated textile strip is rolled up by a winding machine 8.

Table 3 shows appearances of products of the blind slats produced under different conditions.

TABLE 3

| textile material | structure of flattening roller | width of blind slat (cm) | passing speed (m/min) | immerging time (sec) | appearance and property of textile product |
|---|---|---|---|---|---|
| high elastic polyester filament | a combination of the concave, convex and flat parts | 5.1 | 6 | 8; hardening agent and softening agent | flat surface, good elasticity and recoverability after being rolled |
| high elastic polyester filament | only being shaped by a high temperature oven, rather than a flattening roller | 5.1 | 6 | 8; hardening agent and softening agent | disunited width, crumpling and uneven surface |
| high elastic polyester filament | a combination of the concave, convex and flat parts | 5.1 | 6 | 8; only hardening agent | flat surface but poor recoverability |

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of producing textile blind slat, comprising steps of:

(a) weaving an elongated textile strip, wherein two longitudinal edge portions are double layered, for respectively forming elongated inner chambers therein;

(b) immerging the elongated textile strip into a hardening agent, wherein the elongated textile strip passes through the hardening agent at a predetermined speed; the hardening agent comprises rigid polyacrylate latex, thermoplastic polyurethane emulsion, and flame retardant agent;

(c) drying the elongated textile strip after being immerged in the hardening agent at a temperature between 100-180 Celsius degree; and (d) flattening the elongated textile strip by a flattening roller squeezing the textile after being dried at the temperature, so as to serve as a blind slat, wherein the flattening roller has a concave part, a convex part and a flat part provided between the concave part and the convex part, wherein a solid content of the polyacrylate latex is 3-4 times larger than a solid content of the thermoplastic polyurethane emulsion.

2. The method, as recited in claim 1, wherein the solid content of the thermoplastic polyurethane emulsion is 20% to 30% and a glass transition temperature thereof is 35-40 Celsius degree.

3. The method, as recited in claim 2, wherein 20% phosphorus flame retardant, 60% polyacrylate latex and 20% water are added according to mass fraction to form a mixed solution; the mixed solution is further added with the thermoplastic polyurethane emulsion, so as to form the hardening agent.

4. The method, as recited in claim 3, before step (d), further comprising steps of:

(c1) immerging the elongated textile strip into an additive agent, wherein the elongated textile strip passes through the additive agent at a predetermined speed;

(c2) squeezing the elongated textile strip for extruding the extra additive agent and evenly distributing the additive agent on the elongated textile strip; and (c3) drying the elongated textile strip after being immerged in the additive agent at a temperature of 100-180 Celsius degree.

5. The method, as recited in claim 4, wherein the additive agent comprises Fluorinated Compounds added into water based on a ratio of 15-70 g/L to produce a solution whose pH is 4-5, which forms a layer of substances on a surface of the textile to change the surface from a state of high energy into a state of low energy to prevent liquid from passing through the textile, so as to be waterproof.

6. The method, as recited in claim 4, wherein the additive agent comprises an ultraviolet absorber agent added with water based on a ratio of 30-50 g/L to form a solution, which can absorb the ultraviolet and transform the ultraviolet into harmless radiation waves, or reflect the ultraviolet outwards, so as to be protective.

7. The method, as recited in claim 6, wherein the ultraviolet absorber agent can be triazine derivatives.

8. The method, as recited in claim 4, wherein the additive agent comprises a sun screen agent and a coating agent; the sun screen agent is added with water based on a ratio of 2:8.

9. The method, as recited in claim 8, wherein the additive agent is Titanium dioxide.

10. The method, as recited in claim 4, further comprising a step of squeezing the elongated textile strip for extruding the extra hardening agent and evenly distributing the hardening agent on the elongated textile strip.

11. The method, as recited in claim 4, wherein the elongated textile strip is made of polyester selected from a group consisting of polyester filament yarn, polyester drawn textured yarn, polyester high elastic filament, and polyester network filament.

12. The method, as recited in claim 4, wherein the elongated textile strip further comprises at least two rings spacedly provided at a longitudinal side of the elongated textile strip.

13. The method, as recited in claim 2, before step (d), further comprising steps of:

(c1) immerging the elongated textile strip into an additive agent, wherein the elongated textile strip passes through the additive agent at a predetermined speed;

(c2) squeezing the elongated textile strip for extruding the extra additive agent and evenly distributing the additive agent on the elongated textile strip; and (c3) drying the elongated textile strip after being immerged in the additive agent at a temperature of 100-180 Celsius degree.

14. The method, as recited in claim 13, wherein the additive agent comprises Fluorinated Compounds added into water based on a ratio of 15-70 g/L to produce a solution whose pH is 4-5, which forms a layer of substances on a surface of the textile to change the surface from a state of high energy into a state of low energy to prevent liquid from passing through the textile, so as to be waterproof.

15. The method, as recited in claim 13, wherein the additive agent comprises an ultraviolet absorber agent added with water based on a ratio of 30-50 g/L to form a solution, which can absorb the ultraviolet and transform the ultraviolet into harmless radiation waves, or reflect the ultraviolet outwards, so as to be protective.

16. The method, as recited in claim 15, wherein the ultraviolet absorber agent can be triazine derivatives.

17. The method, as recited in claim 1, before step (d), further comprising steps of:

(c1) immerging the elongated textile strip into an additive agent, wherein the elongated textile strip passes through the additive agent at a predetermined speed;

(c2) squeezing the elongated textile strip for extruding the extra additive agent and evenly distributing the additive agent on the elongated textile strip; and (c3) drying the elongated textile strip after being immerged in the additive agent at a temperature of 100-180 Celsius degree.

18. The method, as recited in claim 17, wherein the additive agent comprises Fluorinated Compounds added into water based on a ratio of 15-70 g/L to produce a solution whose pH is 4-5, which forms a layer of substances on a surface of the textile to change the surface from a state of high energy into a state of low energy to prevent liquid from passing through the textile, so as to be waterproof.

19. The method, as recited in claim 17, wherein the additive agent comprises an ultraviolet absorber agent added with water based on a ratio of 30-50 g/L to form a solution, which can absorb the ultraviolet and transform the ultraviolet into harmless radiation waves, or reflect the ultraviolet outwards, so as to be protective.

20. The method, as recited in claim 19, wherein the ultraviolet absorber agent can be triazine derivatives.

* * * * *